United States Patent [19]

Gorin

[11] 4,138,224

[45] Feb. 6, 1979

[54] PRODUCTION OF FIXED BED GASIFIER FEEDSTOCK AND FUELS FROM COAL

[75] Inventor: Everett Gorin, San Rafael, Calif.

[73] Assignee: Continental Oil Company, Stamford, Conn.

[21] Appl. No.: 861,080

[22] Filed: Dec. 15, 1977

[51] Int. Cl.[2] ..... C10L 5/16; C10L 5/14; C10G 1/00

[52] U.S. Cl. ..... 44/23; 44/1 B; 44/24; 208/8

[58] Field of Search ..... 44/23, 24, 1 B; 208/8

[56] References Cited

U.S. PATENT DOCUMENTS

| | | | |
|---|---|---|---|
| 3,791,956 | 2/1974 | Gorin et al. | 208/8 |
| 3,920,418 | 11/1975 | Rice | 208/8 |
| 4,008,054 | 2/1977 | Clancey et al. | 44/10 R |
| 4,075,080 | 2/1978 | Gorin | 208/8 |

*Primary Examiner*—Carl Dees

*Attorney, Agent, or Firm*—D. Leigh Fowler; F. Lindsey Scott; William A. Mikesell

[57] ABSTRACT

A two-step process for the production of fixed bed gasifier feedstock from a coal liquefaction effluent slurry is provided which comprises (a) treating a coal liquefaction effluent slurry in a stirred vessel with a mixture of anti-solvent and coal-derived carbonaceous solids to form agglomerates in a pumpable slurry; and (b) converting the pumpable slurry to larger-size agglomerates or pellets by the addition of further coal-derived carbonaceous solids under pelletizing conditions.

1 Claim, 2 Drawing Figures

PRODUCTION OF FIXED BED GASIFIER FEEDSTOCK AND FUELS FROM COAL

This invention relates to an improvement in coal liquefaction processes, and, more particularly, to the production of pellets suitable for use as a fixed bed gasifier feedstock.

In particular, the invention relates to coal liquefaction processes wherein a solvent (hereinafter sometimes called "liquefaction solvent") is present during the liquefaction of the coal. Liquefaction may be achieved by hydrogenation, depolymerization, extraction, etc. The liquefaction solvent, which is generally coal-derived, may function as solvent for the coal or for the products or both. It may also play a reactive role, for instance, in the depolymerization and hydrogenation of the coal molecules. Liquefaction may also be achieved with or without the presence of a catalyst, and with or without the presence of molecular (gaseous) hydrogen, in addition to the liquefaction solvent. Such liquefaction processes may be used to make liquid and gaseous fuels, as well as low sulfur and non-caking feedstocks for fixed bed gasifiers.

The primary object of the present invention is to provide an improved process for the conversion of coals to fuels; and in its preferred embodiment, to provide a solution to the problem of using the residue from solvent extraction of coal as a feedstock to gasifiers requiring essentially non-caking feedstocks.

SUMMARY OF THE INVENTION

The present invention is a two-step process for the production of fixed bed gasifier feedstock from a coal liquefaction effluent slurry.

The first step involves treating a coal liquefaction effluent slurry in a stirred vessel with a mixture of anti-solvent and coal-derived carbonaceous solids. The purpose of the anti-solvent is to precipitate from the coal liquefaction effluent slurry sufficient asphaltic material to serve as a binder for the agglomeration of both the solids contained in the effluent slurry and the added carbonaceous solids. The agglomerates thus formed are large enough to permit their rapid recovery in a pumpable slurry.

The second step of the process involves conversion of the pumpable slurry from the first step to larger size agglomerates or pellets suitable as a fixed bed gasifier feedstock by the addition of further coal-derived carbonaceous solids under pelletizing conditions.

Figure 1:
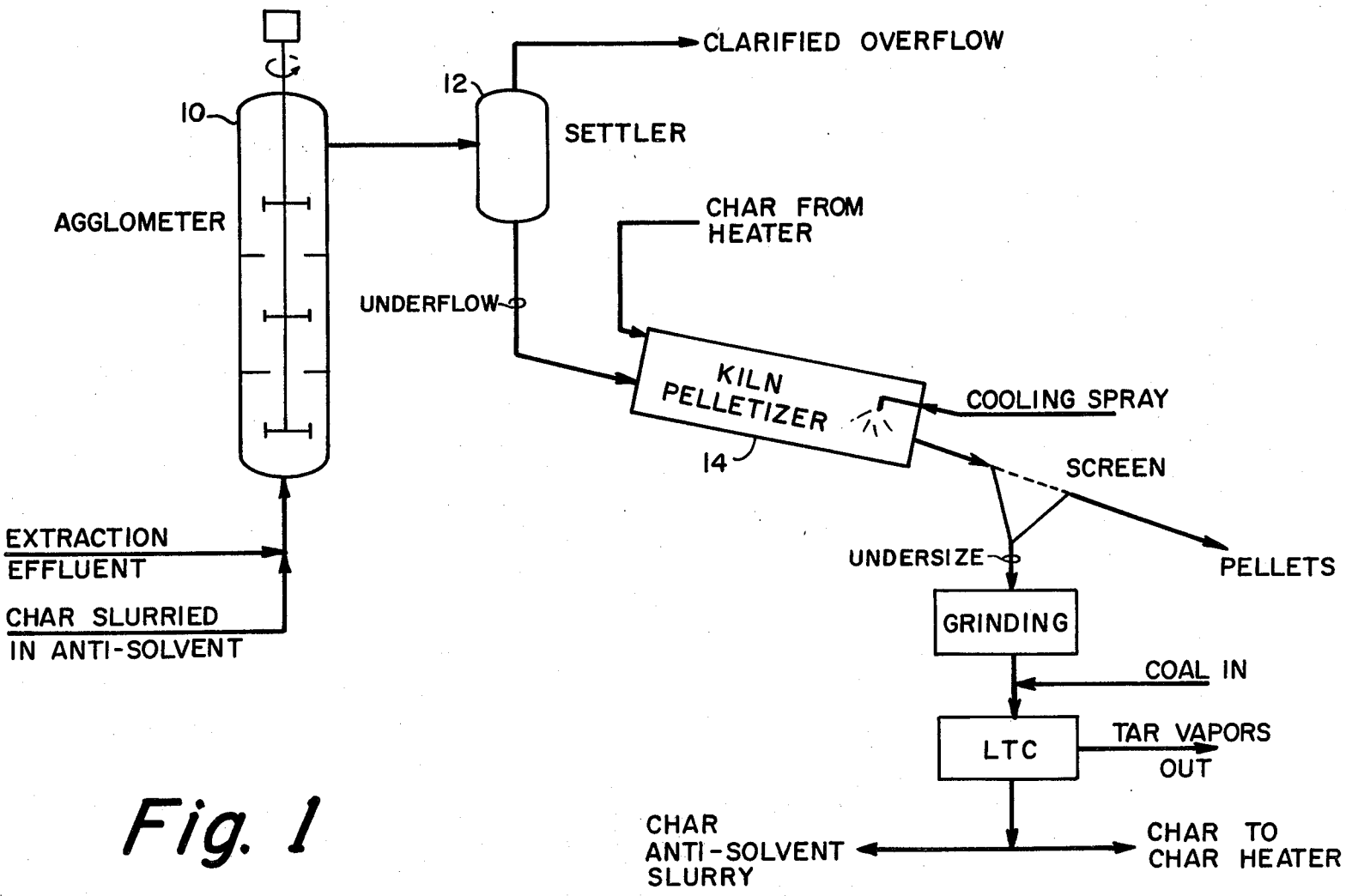
Figure 2:
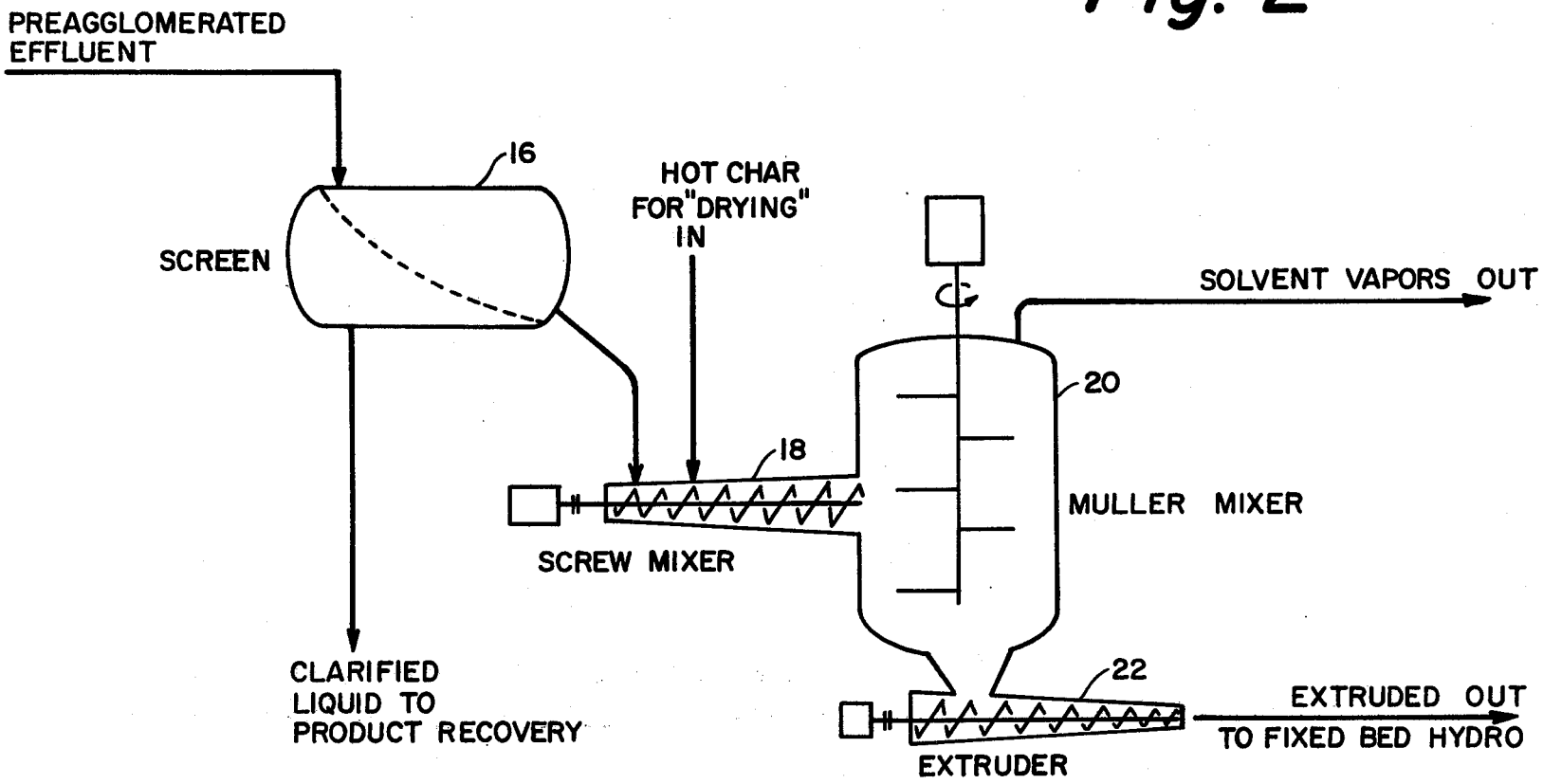

For a better understanding of my invention, its objects and advantages, reference should be had to the following description of two alternative preferred embodiments of my invention and to the accompanying drawings shown in which FIGS. 1 and 2 respectively illustrate the preferred embodiments.

Referring to the drawings, the preferred embodiments of the present invention shown in each FIGURE is one in which the coal liquefaction effluent is an extraction effluent obtained by the use of a coal liquefaction solvent. While the particular method of making the extraction effluent is not part of the present invention, for purposes of orientation, the generally common features of such methods will be described.

Finely divided coal and liquefaction solvent, in a solvent-to-coal weight ratio generally between 1 and 4, are maintained in admixture at a temperature between 300 and 500° C. and a pressure anywhere from 1 to 6500 psig. for such time, 1 to 120 minutes, as is required to achieve the desired conversion, generally between 50 and 95 weight percent of the moisture-and-ash-free coal. Hydrogen gas is generally required to achieve the higher conversions in the above range.

The coal liquefaction solvent is suitably a mixture of polycyclic aromatic hydrocarbons which is liquid under the conditions of temperature and pressure maintained during coal liquefaction. A suitable boiling range for such a solvent, for example, is within the range 250 to 425° C. The solvent may be conveniently derived as a distillate fraction in the overall coal liquefaction process; in other words, from the coal itself. At least a portion of the aromatic hydrocarbons is generally hydrogenated to provide a hydrogen transfer solvent.

After liquefaction of the coal has been satisfactorily achieved, the effluent slurry product is generally subjected to distillation to remove at least the distillables boiling below the coal solvent and also at least some of the coal solvent itself along with any other distillables boiling in the coal solvent range which were produced in the liquefaction of the coal. The distillation is generally conducted under vacuum to facilitate removal of the higher boiling distillables, with avoidance of coking. The lower boiling distillables are removed so as not to interfere with the subsequent separation of anti-solvent and coal solvent, the former generally boiling below the coal solvent. A part of the coal solvent may be removed to permit adjustment of the ratio of coal solvent, not only to the extract, but also to the anti-solvent, thereby regulating the amount of precipitated extract which is to serve as binder in the agglomeration of the residual undissolved solids.

Referring specifically to FIG. 1 of the drawing, the extraction effluent slurry, consisting essentially of a solution of the coal liquefaction product in the liquefaction solvent and undissolved solids, is introduced along with a slurry of char and anti-solvent into an Agglomerator 10. The char is a devolatilized carbonaceous solid obtained in a subsequent step of the process. The selected anti-solvent is any suitable deasphalting solvent which is miscible with the liquefaction solvent but boils below the liquefaction solvent. It generally is paraffinic in nature and may be recovered in the process itself as is now well-known in the art.

The amount, size and density of the char in admixture with the anti-solvent is regulated in the manner taught in the patent application entitled "Deashing of Coal Liquefaction Effluent" filed by Francis P. Burke of even date herewith and assigned to the assignee of the present invention and application. In the present invention, however, the relative amounts of coal solvent, anti-solvent, char and residual solids are adjusted to achieve agglomeration of the total solids in the stirred multi-stage mixing vessel 10 to an agglomerate size smaller than that ultimately desired but large enough to permit rapid settling in a Settler 12.

In Settler 12, the entire product from the Agglomerator 10 is rapidly separated into a clarified overflow and a solids-rich underflow. Extract product, liquefaction solvent and anti-solvent are withdrawn in the overflow from the Settler and separately recovered. The underflow, consisting essentially of the agglomerates in a liquid vehicle composed of extract and some solvents, is fed to a Pelletizer 14 which is adapted to enlarge the agglomerates and deliver them in a relatively dry state as product suitable for further treatment to serve as feed to a fixed bed gasifier.

In this preferred embodiment, the Pelletizer is a rotary kiln which is adiabatically heated by hot recycled undersized product to a temperature below the coking temperature of the underflow feed, but high enough such that liquefaction solvent and anti-solvent in the underflow may be recovered as vapors. As stated, the heat for such vaporization is supplied by hot char which is also agglomerated to form pellets by the surplus extract in solution in the underflow feed. In order to permit screening the product, it must be cooled sufficiently to harden it.

The product pellets, by virtue of the two agglomeration steps, separated by the settling step, are of adequate size, i.e. $+\frac{1}{2}$-inch for gasifier feed, and are not subject to excessive "grape clustering" or disintegration upon shock heating to 500 to 600° C. at the top of the fixed bed gasifier.

The agglomerator and settler are maintained at approximately the same temperature as the pelletizer, i.e. about 300° C.

The cooled undersize pellets from the Pelletizer 14 are ground, mixed with finely divided coal to provide sufficient char; and then subjected to low temperature carbonization in an Low Temperature Carbonization Zone 15, to yield char and tar vapors. The product char is divided into at least two streams; one is sent to a heater to be heated to the temperature required to heat the Pelletizer; and the other stream is slurried with the anti-solvent for introduction into the Agglomerator.

Referring specifically to FIG. 2 of the drawings, a modification of the preferred embodiment of FIG. 1 is shown. The pre-agglomeration step is integrated with screening and extrusion steps to produce a fixed bed gasifier feed, instead of being integrated with a settling step and a pelletizing step as in FIG. 1. The Agglomerator 10 is essentially the same. The pre-agglomerated product effluent from the Agglomerator is conducted to a suitable screen 16 where clarified liquid is recovered as underflow and an agglomerate-rich slurry is recovered as overflow. The underflow from the screening may need a settler for further clarification, but this is not shown. The screened product overflow is mixed with hot char in a pressure reducing Screw Mixer 18 and discharged into a Muller-Mixer 20 operated at substantially atmospheric pressure and about 350–400° C. The hot char provides the heat required to distill nearly all of the anti-solvent plus a large fraction of the liquefaction solvent. The mix is then fed into an Extruder 22 to produce the fixed bed gasifier feedstock. A briquetting press may be used to replace the extruder. One of the advantages of the extrusion and briquetting steps over the pelletizing kiln is that a relatively uniformly sized product is made.

According to the provisions of the patent statutes, the principle, preferred construction and mode of operation of the invention have been explained and what is considered to represent its best embodiment has been illustrated and described. However, it should be understood that, within the scope of the appended claims, the invention may be practiced otherwise than as specifically illustrated and described.

I claim:

1. In a coal liquefaction process which employs a liquefaction solvent wherein a product is recovered which contains a solution of coal liquefaction products in said liquefaction solvent, and finely divided undissolved solids suspended in said solution; and wherein a separation step is included for the separation of said suspended solids from said solution, which uses a precipitating solvent to effect agglomeration of said suspended solids, the improvement which comprises:

(a) mixing said product in an agglomeration zone in admixture with said precipitating solvent and an added amount of relatively coarse coal-derived carbonaceous solids, such that the amount of deposit precipitated by the precipitating solvent serves to bind together said suspended solids and said added amount of solids into agglomerates larger than said added solids;

(b) recovering a pumpable slurry of said enlarged agglomerates from said agglomeration zone;

(c) converting said pumpable slurry in a pelletization zone to pellets larger than said agglomerates produced in said agglomeration zone by the further addition of coal-derived carbonaceous solids under pelletizing conditions; and (d) recovering enlarged pellets from said pelletization zone.

* * * * *